United States Patent [19]

Coleman

[11] 3,958,045

[45] *May 18, 1976

[54] METHOD OF MAKING AN AUTOMATIC VOLUME CONTROL PIPET

[76] Inventor: Charles M. Coleman, 958 Washington Road, Pittsburgh, Pa. 15228

[ * ] Notice: The portion of the term of this patent subsequent to Jan. 8, 1991, has been disclaimed.

[22] Filed: Aug. 8, 1973

[21] Appl. No.: 386,823

Related U.S. Application Data

[62] Division of Ser. No. 206,442, Dec. 9, 1971, Pat. No. 3,783,696.

[52] U.S. Cl. ..... 427/230; 73/425.4 P; 427/256; 427/287; 427/430

[51] Int. Cl.[2] ..... B05D 7/22; B01L 3/02

[58] Field of Search ..... 117/97, 113; 141/18, 141/31, 94, 98; 73/425.4 P, 425.6, 426; 23/292; 128/233; 138/146, DIG. 3; 427/230, 287, 430

[56] References Cited

UNITED STATES PATENTS

| | | | |
|---|---|---|---|
| 2,111,576 | 3/1938 | Stewart | 117/97 X |
| 2,498,485 | 2/1950 | Clawson | 117/97 X |
| 2,501,737 | 3/1950 | Porter et al. | 117/97 X |
| 2,694,018 | 11/1954 | Gehnrich | 117/97 |
| 2,944,298 | 7/1960 | Bernhardt et al. | 117/97 X |
| 2,974,528 | 3/1961 | Sanz | 73/425.4 P |
| 3,138,299 | 6/1964 | Staunton | 73/425.4 P X |
| 3,285,296 | 11/1966 | Ishimaru et al. | 128/233 X |
| 3,406,573 | 10/1968 | Burke | 73/425.6 |
| 3,500,689 | 3/1970 | Band | 73/425.4 P |
| 3,641,823 | 2/1972 | Harris et al. | 73/425.4 P |
| 3,783,696 | 1/1974 | Coleman | 23/292 X |

*Primary Examiner*—Harry J. Gwinnell
*Assistant Examiner*—Stuart D. Frenkel
*Attorney, Agent, or Firm*—Arnold B. Silverman

[57] ABSTRACT

An automatic filling capillary pipet having a tubular body defining an elongated bore having a fluid entry end. The interior surface of the tubular body having a first zone with hydrophobic means for resisting wetting by aqueous liquids. The tubular body interior surface having a second zone which is hydrophilic with respect to aqueous fluids. Introduction of an aqueous fluid into the elongated bore will effect retention therein of a predetermined volume of aqueous fluid proportional to the cross section of the bore and the length of the second zone. In one embodiment the hydrophobic first zone originates at a position spaced from the fluid entry end and the hydrophilic second zone is disposed between the first zone and the fluid entry end. In another embodiment a hydrophobic third zone is disposed intermediate the hydrophilic second zone and the fluid entry end.

A method of making the above-identified type of pipet by providing a tubular pipet body composed of a hydrophilic glass material and establishing a hydrophobic first zone within the tubular pipet body, as by immersion, and providing a hydrophilic second zone between the fluid entry end of the tube and the first zone. A hydrophobic third zone may be established between the fluid entry end and the second zone.

3 Claims, 4 Drawing Figures

METHOD OF MAKING AN AUTOMATIC VOLUME CONTROL PIPET

This is a division of application Ser. No. 206,442, filed Dec. 9, 1971, now U.S. Pat. No. 3,783,696.

BACKGROUND OF THE INVENTION

1. Field of the Invention

This invention relates to an automatic filling capillary pipet which is adapted to receive a predetermined volume of an aqueous liquid without requiring manual effort to precisely align the liquid upper level with a pipet calibration line.

2. Description of the Prior Art

In numerous laboratory uses small diameter or micro-tubular pipets are employed in order to receive and transfer relatively small quantities of liquid. These pipets are frequently composed of tubular glass and provided with at least one volume indicating graduation in order to permit the receipt and discharge of a precisely measured volume of fluid. Liquid is frequently introduced into the pipet by suction as by a dropper type bulb or suction hose attached to the upper end thereof. Also, liquid is frequently introduced into the pipet by capillary action such as is encountered in withdrawing blood from a finger puncture in a patient.

One of the difficulties encountered in conventional pipets is the need to precisely monitor the inward flow of the fluid into the pipet. Inward flow must be terminated at the precise moment when the meniscus of the liquid in the pipet is positioned at the desired calibration line on the pipet in order to insure receipt and delivery of a specific predetermined volume of the fluid. This procedure is, of necessity, relatively slow, cumbersome and somewhat inefficient and requires a high degree of skill on the part of the user. In view of the rapid acceleration in the annual volume of clinical laboratory tests which employ pipets coupled with the need to maintain or improve the accuracy of such tests and the need to free skilled laboratory personnel for other responsibilities, there remains a substantial need for an automatic control pipet which is easy to operate, even in the hands of relatively unskilled individuals.

There remains, therefore, a need for a pipet which is adapted to automatically and rapidly transfer a precise predetermined quantity of liquid into the hollow interior without involving manual technique and human measurement coupled with all of the resultant undesirable features.

SUMMARY OF THE INVENTION

The above-described need has been met by the present invention. The present invention provides an automatic filling capillary pipet which has an elongated tubular body provided with a fluid entry end. The interior surface of the tubular body has a first zone with hydrophobic means for resisting wetting by aqueous fluids. The interior surface also has a second zone which is hydrophilic with respect to aqueous fluids. As a result, introduction of an aqueous fluid into the elongated bore through the fluid entry end will result in retention of a volume of fluid which is proportionate to the cross section of the tubular body bore and the length of the second zone. In one form of the invention the hydrophobic first zone originates at a position spaced from the fluid entry end and the hydrophilic second zone originates at or adjacent the fluid entry end and extends continuously to the first zone. Graduation or calibration means may be provided intermediate the first and second zones.

In another embodiment of the invention a third zone which has hydrophobic means is interposed between the second zone and the fluid entry end. This results in a predetermined volume of the aqueous fluid being received intermediate the first and third zones.

In one preferred form of the invention the hydrophobic means is a coating of material selected from the group consisting of silicones, fluorocarbons and hydrocarbons.

It is an object of this invention to provide an automatic filling capillary pipet which is adapted to receive and retain for subsequent discharge a predetermined volume of an aqueous fluid without the need for manual control.

It is another object of this invention to provide a disposable capillary pipet which is adapted to both "to contain" and "to deliver" pipet deliveries.

It is another object of this invention to provide an automatic filling capillary pipet wherein the volume which will automatically be received and retained in the pipet may be precisely determined and be employed for a wide range of volumes.

These and other objects of the invention will be more fully understood from the following description of the invention, on reference to the illustrations appended hereto.

DESCRIPTION OF THE PREFERRED EMBODIMENTS

The present invention relates generally to automatic filling pipets of various types. For convenience of reference herein, the term "capillary pipet" will be used to refer generically to various forms of pipets regardless of whether or not they are to be filled by capillary action. The terms "aqueous fluid" and "aqueous liquid" as used herein shall refer to fluids which have a substantial percentage of water on a volume basis and the use of such terms shall expressly include blood and urine, as well as chemically modified blood and urine specimens and other fluids having a substantial water concentration.

Figure 1:
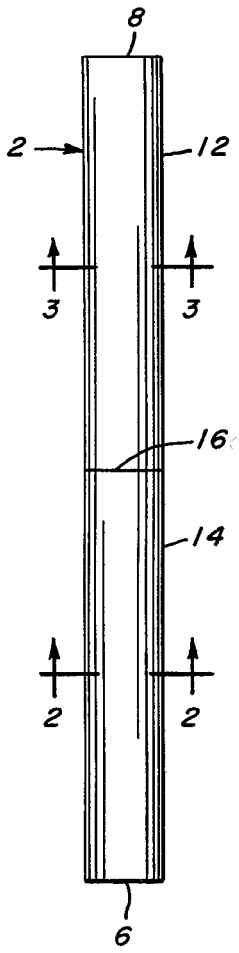
FIG. 1 is an elevational view of a form of capillary pipet of this invention.
Figure 2:
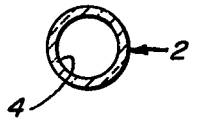
FIG. 2 is a cross sectional illustration of the capillary pipet of FIG. 1 taken through 2—2 of FIG. 1.
Figure 3:
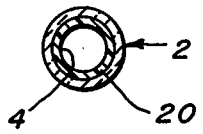
FIG. 3 is a cross sectional illustration of the pipet of FIG. 1 taken through 3—3 of FIG. 1.

Referring now more specifically to FIGS. 1 through 3, there is shown an elongated capillary pipet which has a tubular body 2 defining an elongated bore or passageway 4. The tubular body 2 has a fluid entry opening 6 at one end and a venting opening 8 at the other end. The tubular body 2 has a first zone 12 which has hydrophobic means for resisting wetting by aqueous fluids. Intermediate the first zone 12 and the fluid entry opening 6 is a second zone 14 which has a surface which is hydrophilic with respect to aqueous fluids. The elongated bore 4 in the second zone 14 preferably has an average internal diameter of about 0.1 to 1.5 millimeters. In the form illustrated a graduation mark 16, which may conveniently be a mark applied to the exterior surface of the tubular body 2 or a line etched into the same, indicates the line of division between first zone 12 and second zone 14.

In the form illustrated in FIGS. 1 through 3, the tubular body is composed of glass and second zone 14 need not be coated as the surface is naturally hydrophilic with respect to aqueous fluids. First zone 12 is provided with a continuous interior coating or layer 20 which consists of a material which is hydrophobic with respect to aqueous fluids. While the coating material may be any suitable hydrophobic material, the preferred materials are those selected from the group consisting of silicones, fluorocarbons and hydrocarbons. Among the hydrocarbons which may be economically employed is petroleum jelly. Also, chloro or alkoxy silanes such as methyl trichlorosilanes or methyl trimethoxysilanes, for example, may be used to siliconize the first zone 12. The interior coating in zone 12 should be substantially continuous and may be of any thickness which maintains adequate continuity for the coating to function in a hydrophobic fashion and yet maintains the opening in elongated bore 4 sufficiently to permit venting therethrough. If desired, the edge of capillary pipet adjacent fluid entry opening 6 may be coated with a hydrophobic material in order to resist adherence of superfluous fluid to the tube edge.

One convenient means of applying the hydrophobic coating to zone 12 is to provide a solution of the coating material and immerse the pipet in the solution to the precise depth to which coating is desired. The fluid solution, for example, may be methyl trimethoxysilane in water or methyl trichlorosilane in a suitable organic solvent, such as toluene. The pipet may then be removed and permitted to dry.

In using the pipet shown in FIGS. 1 through 3, one may rely on capillarity to introduce the aqueous fluid into the pipet. In effecting aqueous fluid introduction, the fluid entry opening 6 is placed in contact with the aqueous fluid desired to be introduced into the pipet interior. The fluid will automatically advance to graduation marker 16, preferably by capillarity, and will not be retained above the marker 16 as the fluid will not wet the surface of first zone 12. As a result, the fluid will instantaneously and automatically enter and be retained within the pipet interior in a precisely controlled volume determined by the length of second zone 14 and the interior cross sectional dimension of second zone 14. In this fashion, the time consuming and somewhat inaccurate human dependent approach to pipet filling is dispensed with and efficient reliable automatic volume receipt is insured.

The pipet shown in FIGS. 1 through 3 may be employed in a "to contain" pipet delivery. In this form of delivery, when it is desired to transfer the blood or other aqueous fluid, the aqueous fluid can be washed out of the pipet by means of the liquid into which the transferred aqueous fluid is to be received.

Another approach to the general embodiment shown in FIG. 1 is to employ a tubular material which is generally hydrophobic such as a plastic, and permit the material to serve as the first zone while the interior of the second zone is treated in order to render it hydrophilic. For example, the interior of the second zone of a plastic tube might be oxidized to render it hydrophilic.

Figure 4:
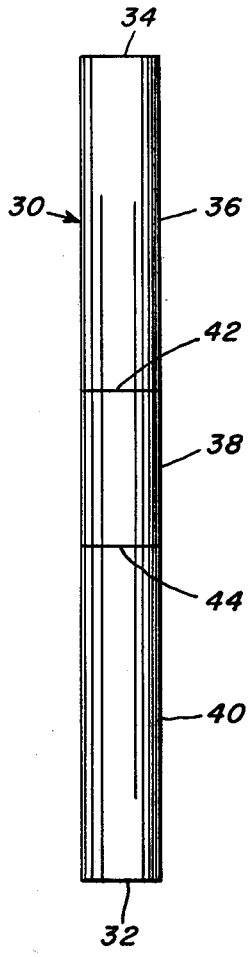
FIG. 4 is an elevational view of a modified form of pipet of this invention.

Referring now to FIG. 4, another embodiment of the invention will be considered. In this form of the invention the pipet has an elongated tubular body 30 generally similar to that of the pipet of FIG. 1. Tubular body 30 has a fluid entry opening 32 and a venting opening 34. The body interior surface, which will generally be circular in cross section, has a first zone 36 which has hydrophobic means, a second zone 38 which is hydrophilic and a third zone 40 which is also hydrophobic. In this form of the invention an aqueous liquid entering fluid entry opening 32 will travel upwardly to second zone 38 and be retained therein. It is noted that a graduation mark 42 separates first zone 36 from second zone 38. Similarly, a graduation mark 44 separates second zone 38 from third zone 40. The volume of fluid retained within the pipet tubular body 30 will be proportionate to the length of second zone 38 and the interior cross sectional dimension of second zone 38.

The pipet shown in FIG. 4 may be used in a "to deliver" type pipet delivery. In this form of delivery the predetermined volume of aqueous fluid which is retained within second zone 38 may be transferred into a receiving vessel by blowing into one end, generally venting opening 34 of tubular body 30. In this fashion, the predetermined precise volume of aqueous fluid is received within the pipet interior in automatic fashion and is effectively delivered.

As was true with the first embodiment of the invention, if desired the tube may be composed of a naturally hydrophobic material with second zone 38 being treated to establish a hydrophilic surface. In view of the location of second zone 38, however, it will generally be more convenient to employ a tube composed of a hydrophilic material. Also, it will be appreciated that will all embodiments of this invention the naturally hydrophilic or naturally hydrophobic zones of a pipet may be treated in order to improve these desired characteristics within specific zones.

While the pipet of this invention is not dimensionally limited, it should be noted that it is particularly suitable for use with micro-capillary pipets which have an average internal diameter in the liquid retaining zones of less than 2 millimeters and preferably have an average internal diameter in these zones of about 0.1 millimeter to 1.5 millimeters and are used in receiving volumes of liquids to about 1 to 100 microliters. The average internal diameter range of about 0.1 to 1.5 millimeters is preferred for maximum precision and increased repeatability of meniscus contour, with further improvement being obtained as the diameter is reduced within this range.

It should also be noted that while the examples herein described have referred expressly to glass and plastic pipets and these are the preferred materials, the invention is not so limited and other materials and combinations of materials may be employed.

While for purposes of simplicity of illustration the pipets shown have a substantially continuous transverse internal bore dimension throughout their longitudinal extent, if desired variations in cross sectional dimension at various locations may be provided. A small bore intake tube with or without a capillary tip, for example, may be employed. Also, a small bore upper portion may be provided if desired.

It will, therefore, be appreciated that the automatic volume control capillary pipet of this invention is adapted to eliminate the undesirable and relatively slow and inaccurate human participation in volume control and provide for simple, automatic precise introduction and retention of a predetermined volume of an aqueous fluid. This may be accomplished in an economical fashion with simple chemical treatment of a portion or all of the pipet interior. The invention is particularly suited for use with disposable small bore pipets including capillary glass pipets. Also, no special equipment is required for the use of the pipets, nor is specialized skill required as the human factor has been substantially completely eliminated. Finally, the system is readily adapted for use in conventional discharge techniques and accelerates the sampling and analytical testing processes.

Whereas particular embodiments of the invention have been described above for purposes of illustration, it will be evident to those skilled in the art that numerous variations of the details may be made without departing from the invention as defined in the appended claims.

I claim:

1. A method of manufacturing a pipet comprising providing an elongated tubular pipet body composed of a hydrophilic glass material and defining a continuous interior passageway having a fluid entry end and a venting end, subsequently establishing a hydrophobic first zone within said tubular pipet body by coating said passageway with a layer of hydrophobic material selected from the group consisting of silicones, fluorocarbons and hydrocarbons, an uncoated portion of said tubular pipet providing a hydrophilic second zone within said passageway between said first zone and said fluid entry end, and establishing a hydrophobic third zone between said fluid entry end and said hydrophilic second zone by coating said third zone with a layer of hydrophobic material selected from the group consisting of silicones, fluorocarbons and hydrocarbons, whereby said pipet body of hydrophilic glass material will be provided with hydrophobic and hydrophilic zones which permit automatic retention within said pipet passageway of a predetermined volume of an aqueous fluid less than the full volume of said pipet passageway.

2. A method of manufacturing a pipet comprising providing an elongated tubular pipet body composed of a hydrophilic glass material and defining a continuous interior passageway having a fluid entry end and a venting end, subsequently establishing a hydrophobic first zone within said tubular pipet body by coating said passageway with a layer of hydrophobic material selected from the group consisting of silicones, fluorocarbons and hydrocarbons, an uncoated portion of said tubular pipet providing a hydrophilic second zone within said passageway between said first zone and said fluid entry end, whereby said pipet body of hydrophilic glass material will be provided with hydrophobic and hydrophilic zones which permit automatic retention within said pipet passageway of a predetermined volume of an aqueous fluid less than the full volume of said pipet passageway, establishing a hydrophobic third zone between said fluid entry end and said hydrophilic second zone by coating said third zone with a layer of hydrophobic material selected from the group consisting of silicones, fluorocarbons and hydrocarbons, establishing said hydrophobic third zone coating by immersing said pipet body in a solution of said hydrophobic material to wet said pipet body within said passageway to the depth to which said third zone is desired, and subsequently removing said pipet body from said solution and permitting it to dry.

3. The method of claim 2 including providing graduation means on said pipet body adjacent abutting edges of said second and third zones.

* * * * *